US008471548B2

(12) United States Patent
Noda

(10) Patent No.: US 8,471,548 B2
(45) Date of Patent: Jun. 25, 2013

(54) POWER SUPPLY CIRCUIT CONFIGURED TO SUPPLY STABILIZED OUTPUT VOLTAGE BY AVOIDING OFFSET VOLTAGE IN ERROR AMPLIFIER

(75) Inventor: Ippei Noda, Ikeda (JP)

(73) Assignee: Ricoh Company, Ltd., Tokyo (JP)

( * ) Notice: Subject to any disclaimer, the term of this patent is extended or adjusted under 35 U.S.C. 154(b) by 334 days.

(21) Appl. No.: 12/905,492

(22) Filed: Oct. 15, 2010

(65) Prior Publication Data

US 2011/0095745 A1 Apr. 28, 2011

(30) Foreign Application Priority Data

Oct. 27, 2009 (JP) ..... 2009-246693

(51) Int. Cl.

| | |
|---|---|
| ***G05F 3/04*** | (2006.01) |
| ***G05F 3/08*** | (2006.01) |
| ***G05F 3/16*** | (2006.01) |
| ***G05F 3/20*** | (2006.01) |

(52) U.S. Cl.
USPC ..... 323/312; 323/313

(58) Field of Classification Search
USPC ..... 323/312–315
See application file for complete search history.

(56) References Cited

U.S. PATENT DOCUMENTS

| | | | | |
|---|---|---|---|---|
| 7,126,413 | B2 * | 10/2006 | Filoramo et al. | 330/2 |
| 7,176,753 | B2 | 2/2007 | Noda et al. | |
| 7,301,315 | B2 | 11/2007 | Noda | |
| 7,622,901 | B2 | 11/2009 | Noda | |
| 7,705,573 | B2 | 4/2010 | Noda | |
| 2007/0030055 | A1 * | 2/2007 | Hasegawa | 327/543 |
| 2009/0066306 | A1 | 3/2009 | Noda | |
| 2010/0079121 | A1 * | 4/2010 | Yanagawa | 323/277 |

FOREIGN PATENT DOCUMENTS

| | | |
|---|---|---|
| JP | 2006-109349 | 4/2006 |
| JP | 2006-350722 | 12/2006 |
| JP | 2007-11709 | 1/2007 |
| JP | 2007-249384 | 9/2007 |
| JP | 2007-249523 | 9/2007 |
| JP | 2007-304716 | 11/2007 |
| JP | 2008-177330 | 7/2008 |
| JP | 2008-199804 | 8/2008 |
| JP | 2009-69964 | 4/2009 |
| JP | 4362382 | 8/2009 |
| JP | 2009-258809 | 11/2009 |
| JP | 4402465 | 11/2009 |
| JP | 2009-303317 | 12/2009 |
| JP | 2010-191869 | 9/2010 |
| JP | 2010-191870 | 9/2010 |

* cited by examiner

*Primary Examiner* — Adolf Berhane
*Assistant Examiner* — Emily Pham
(74) *Attorney, Agent, or Firm* — Cooper & Dunham LLP

(57) ABSTRACT

A power supply circuit includes an output driver transistor, a buffer circuit, and an error amplification circuit. The buffer circuit includes a first transistor connected to an output terminal and a second transistor functioning as a load for the first transistor. The error amplification circuit includes a differential pair including a first pair of transistors, a current mirror circuit including a second pair of transistors, a constant current source supplying a current and driving the differential pair and the current mirror circuit, a third transistor connected between one of the differential pair and the current mirror circuit. The first and second transistor have the same polarity as the transistors constituting the current mirror circuit, and control terminals of the first and third transistors are connected at a first junction node that is connected to a second junction node between the one of the differential pair and the third transistor.

9 Claims, 2 Drawing Sheets

POWER SUPPLY CIRCUIT CONFIGURED TO SUPPLY STABILIZED OUTPUT VOLTAGE BY AVOIDING OFFSET VOLTAGE IN ERROR AMPLIFIER

BACKGROUND OF THE INVENTION

1. Field of the Invention

The present invention relates to a power supply circuit, using a series regulator, to response load current flowing to the power supply circuit and controls the fluctuation of an output voltage thereof 2. Description of the Related Art Certain power supply circuit uses a series regulator.

FIG. 1 illustrates circuitry of a related-art power supply circuit 100 using a series regulator, as disclosed in JP-2005-196354-A.

In the related art power supply circuit 100 shown in FIG. 1, because a significant voltage difference is generated between a drain voltage of the PMOS transistor M103 and a drain voltage of a positive channel metal oxide semiconductor (PMOS) transistor M104, and an input conversion offset voltage of an error amplifier 103 increases as a result, an error in the output voltage of the power supply circuit 100 may be generated. For example, assume that an output driver transistor M105, the PMOS transistors M103, M104, M106 and M107 are the same conductive type and the same size, and are driven by the same constant current. At this time, when a gate-source voltage of the PMOS transistor M104 is set as Vgs104, a drain voltage Vd104 of the PMOS transistor M104 is calculated by the following Formula a.

$$Vd104=Vdd+Vgs104 \quad \text{(a)}$$

On the other hand, when the gate-source voltage of the output driver transistor M105 and the PMOS transistor M106 are represented respectively as Vgs105 and Vgs106, a drain voltage Vd103 of the PMOS transistor M103 is calculated by the following Formula b.

$$Vd103=Vdd+Vgs105+Vgs106 \quad \text{(b)}$$

As a result, influence of a channel-length modulation effect, which depends on drain voltage, differs between the PMOS transistors M103 and M104, which causes an offset voltage. Similarly, in negative-channel metal oxide semiconductor (NMOS) transistors M101 and M102 constituting the differential pair, the drain voltage difference therebetween is generated, causing the offset voltage.

These offset voltages change due to various factors, such as inconsistencies transistor quality occurring in the manufacturing process, fluctuations in the power supply voltage, changes in temperature, and so forth. Therefore, the power supply circuit may not supply a stable voltage.

In view of the foregoing, there is market demand for a power supply circuit that quickly responds to rapid changes in load current, has reduced power consumption, and is unaffected by inconsistencies in transistor quality occurring in the integrated circuit (IC) manufacturing process, while avoiding any substantial increase in the size of the circuit.

SUMMARY OF THE INVENTION

A power supply circuit generates a predetermined constant voltage from an input voltage to output the predetermined constant voltage as an output voltage and includes an input terminal and an output terminal, an output driver transistor, a buffer circuit, and an error amplification circuit. The output driver transistor generates a predetermined current according to a control signal input from the input terminal and outputs the predetermined current from the output terminal. The buffer circuit controls the output driver transistor according to the inputted control signal and includes a first transistor connected to the output terminal and a second transistor to functioning as a load for the first transistor. The error amplification circuit controls the output driver transistor via the buffer circuit to make a proportional voltage proportional to the output voltage equal to a predetermined reference voltage. The error amplification circuit includes a differential pair, a current mirror circuit, a constant current source, and a third transistor. The differential pair includes a first pair of transistors. The current mirror circuit includes a second pair of transistors and functions as a load for the differential pair. The constant current source supplies a current and drives the differential pair and the current mirror circuit. The third transistor is connected between one of the first pair of transistors constituting the differential pair and one of the second pair of transistors constituting the current mirror circuit. The first transistor and the second transistor have the same polarity as the second pair of transistors constituting the current mirror of the error amplification circuit. Control terminals of the first transistor and the third transistor are connected at a first junction node therebetween, and the first junction node is connected to a second junction node between one of the first pair of transistors constituting the differential pair and the third transistor.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
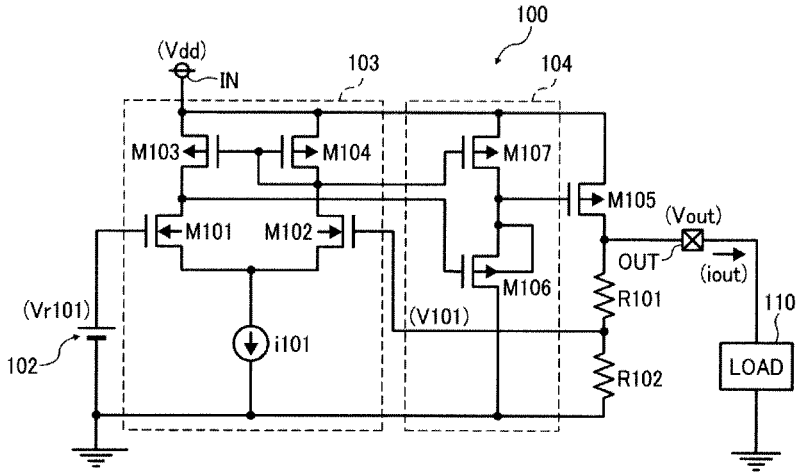
FIG. 1 RELATED ART
FIG. 1 illustrates circuitry of a related-art power supply circuit.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views thereof, particularly to FIG. 2, a power supply circuit 1 according to an example embodiment of the present invention is described below.

(First Embodiment)

Figure 2:
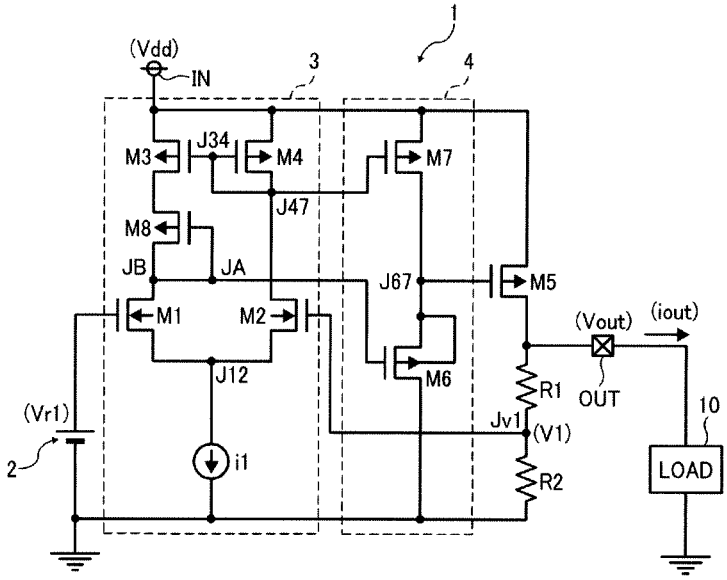
FIG. 2 illustrates circuitry of a power supply circuit according to a first illustrative embodiment.

FIG. 2 illustrates circuitry of the power supply circuit 1 according to a first embodiment.

The power supply circuit 1 functions as a series regulator in which a power supply voltage Vdd inputted through an input terminal IN is converted to a predetermined voltage for output as an output voltage Vout via an output terminal OUT.

In FIG. 2, the power supply circuit 1 includes a reference voltage source 2, resistors R1 and R2, an error amplifier 3, a buffer circuit 4, and an output driver transistor M5. The reference voltage source 2 generates and outputs a predetermined reference voltage Vr1. The resistors R1 and R2 divide the output voltage Vout to generate and output a divided voltage V1 that sets the output voltage Vout. The error amplifier 3 compares the divided voltage V1 and the reference voltage Vr1 and outputs the comparison result to control the buffer circuit 4. The output driver transistor M5 is constituted by a positive-channel metal oxide semiconductor (PMOS) transistor. The buffer circuit 4 controls the output driver transistor M5 according to a control signal inputted from the input terminal IN.

The error amplifier 3 includes a pair of negative-channel MOS (NMOS) transistors M1 and M2 (a first pair of transistors) functioning as a differential pair, a pair of PMOS transistors M3 and M4 (a second pair of transistors) functioning as a current mirror circuit that functions as a load for the differential pair of the NMOS transistors M1 and M2, a PMOS transistor M8 connected between the NMOS transistor M1 and the PMOS transistor M3, and a constant current source i1 that supplies a current to these MOS transistors M1 through M4 and M8. The buffer circuit 4 includes PMOS transistors M6 and M7.

It is to be noted that the reference voltage source 2, the resistors R1 and R2, and the error amplifier 3 together serve as an error amplification circuit, the buffer circuit 4 serves as a buffer circuit, the PMOS transistor M6, M7, M8 serves as a first transistor, a second transistor, and a third transistor, respectively.

In the error amplifier 3, the sources of the PMOS transistors M3 and M4 are respectively connected to the input terminal IN inputting the power supply voltage Vdd. The gates (control terminal) of the PMOS transistors M3 and M4 are connected to each other at a junction node J34, and the junction node J34 therebetween is connected to the drain of the PMOS transistor M4 at a junction node J47. The drain of the PMOS transistor M3 is connected to the source of the PMOS transistor M8, the gate and the drain of the PMOS transistor M8 are connected to the drain of the NMOS transistor M1 at a junction node JB. The junction node JB serves as a second junction node. The drain of the PMOS transistor M4 is connected to the drain of the NMOS transistor M2 at the junction node J47. The source of the NMOS transistors M1 and M2 is connected each other at a junction node J12. The constant current source i1 is connected between the junction node J12 and a ground terminal. In addition, the reference voltage Vr1 is inputted to the gate of the NMOS transistor M1, and the divided voltage V1 is inputted to the gate of the NMOS transistor M2.

Further, the PMOS transistors M6 and M7 are connected in series between the input terminal IN inputting the power supply voltage Vdd and the ground terminal, and the gate of the PMOS transistor M6 is connected to a junction node JA between the gate (control terminal) of the PMOS transistor M8 and the drain of the NMOS transistor M1 The junction node JA therebetween is one output terminal of the error amplifier 3 and serves as a first junction node, The gate of the PMOS transistor M7 is connected to the junction node J47 between the drain of the NMOS transistors M2 and the drain of the PMOS transistor M4, and the junction node J47 is the other output terminal of the error amplifier 3.

In addition, the output driver transistor M5 is connected between the input terminal IN inputting the power supply voltage Vdd and the output terminal OUT, and generates a predetermined current according to a control signal from the input terminal IN to output the predetermined current to the output terminal OUT. The resistors R1 and R2 are connected in series between the output terminal OUT and the ground terminal. The gate of the output driver transistor M5 is connected to a junction node J67 between the PMOS transistors M6 and M7. A junction node Jv1 between the resistors R1 and R2 is connected to the gate (control terminal) of the NMOS transistor M2. The substrate gate of the PMOS transistor M6 is connected to the source thereof. A load 10 is connected between the output terminal OUT and the ground terminal.

With this circuit configuration, in a steady operating state, the error amplifier 3 and the buffer circuit 4 control the output driver transistor M5 to make the divided voltage V1 equal to the reference voltage Vr1, thereby stabilizing the output voltage Vout such that a constant current is supplied to the load 10. Herein, when an output current iout outputted from the output terminal OUT to the load 10 rapidly increases, the output voltage Vout decreases. Then, the amount of decrease in the output voltage Vout is by divided by the resistors R1 and R2 to generate the divided voltage V1, and the divided voltage V1 is fed back to the NMOS transistor M2 in the error amplifier 3 so that the NMOS transistor M2 is turned off.

As described above, because the PMOS transistors M3 and M4 function as the current-mirror circuit, the current amount outputted from the PMOS transistors M3 and M4 becomes smaller than the current amount supplied from the constant current source i1. Then, as the current outputted from the PMOS transistors M3 and M4 becomes smaller, an equivalent electronic charge accumulated in a gate capacity of the PMOS transistor M6 is discharged so that the PMOS transistor M6 is turned on. Because a chip of the PMOS transistor M6 can be smaller than the output driver transistor M5, the effect on the speed of response is slight even when the current in the constant current source i1 is small. Further, because the PMOS transistor M7 forms the current mirror circuit with the PMOS transistor M4, the current flowing from the PMOS transistors M7 is decreased.

Accordingly, drawing ability of the electric charge from the PMOS transistor M6 and amount of current reduction of the PMOS transistor M7 becomes equal to the discharging ability of the gate capacity of the output driver transistor M5. Then, the gate voltage of the output driver transistor M5 is rapidly decreased so that the output driver transistor M5 is turned on by rapidly decreasing the gate voltage of the output driver transistor M5, thereby increasing the output voltage Vout. Finally, the output voltage Vout is stabilized so that the divided voltage V1 is set equal to the reference voltage Vr1.

The steady current of the power supply circuit 1 is determined based on the current supplied from the constant current source i1. Further, the PMOS transistor M7 forms the current mirror circuit with the PMOS transistors M3 and M4. Therefore, even when inconsistencies in transistor quality occur in the manufacturing process, a substantial increase of the steady current and significant deterioration of response characteristics can still be prevented.

As described above, the power supply 1 that uses only two PMOS transistors M6 and M7 can provide a circuit that controls the output driver transistor M5 to charge and discharge the gate capacity of the output driver transistor M5 at a high speed. With this circuit configuration, the power supply circuit 1 can be arranged without a large increase in chip area. Further, the power supply circuit 1 consumes relatively little power and is only slightly affected by inconsistencies in transistor quality occurring in the manufacturing process. Accordingly, the power supply device 1 can quickly respond to rapid changes in load current.

Next, the operation of the PMOS transistor M8 is described below.

For example, the output driver transistor M5, the PMOS transistors M3, M4, M6, M7, and M8 are same conductive type and same size and are driven by same constant current.

That is, the first and second transistors M6 and M7 have same polarity as the transistors M3 and M4 constituting the current mirror circuit and the third transistor M8. At this time, when a gate-source voltage of the PMOS transistor M4 is set as Vgs4, a drain voltage Vd4 of the PMOS transistors M4 is calculated by the following Formula 1.

$$Vd4=Vdd+Vgs4 \quad \text{(Formula 1)}$$

On the other hand, when the gate-source voltage of the output driver transistor M5, the PMOS transistor M6 and M8 represent respective Vgs5, Vgs6, and Vgs8, a drain voltage Vd3 of the PMOS transistor M3 is calculated by the following Formula 2.

$$Vd3=Vdd+Vgs5+Vgs6-Vgs8 \quad \text{(Formula 2)}$$

For example, when the output driver transistor M5, the PMOS transistors M4, M6, and M8 are same conductive type and same size and are driven by the same constant current, the voltage generated in the gate-source voltage Vgs become equal each other, therefore, the relation of the voltage values is represented by the following Formula 3.

$$Vgs4=Vgs5=Vgs6=Vgs8 \quad \text{(Formula 3)}$$

Therefore, with reference to the formula 1 through 3, the voltage relation of the drain voltage Vd3 of the PMOS transistor M3 and the drain voltage Vd4 of the PMOS transistor M4 are expressed by Vd3=Vd4, that is, the drain voltage Vd3 of the PMOS transistor M3 is set equal to the drain voltage Vd4 of the PMOS transistor M4, the PMOS transistors M3 and M4 do not effect channel-length modulation effects depending on the drain voltages, which prevents offset voltage from generating.

As described above, the power supply 1 that uses two transistors, which are the PMOS transistors M6 and M7, can realize a circuit controlling the output driver transistor M5 to charge and discharge at a high speed the gate capacity of the output driver transistor M5. With this configuration, the power supply circuit 1 can be arranged without a large increase of chip area. Further, the power supply circuit 1 consumes relatively little power, and is only slightly affected by inconsistencies in transistor quality occurring in the manufacturing process. Accordingly, the power supply device 1 can quickly respond to rapid changes in load current.

In addition, by providing the PMOS transistor M8 between the PMOS transistor M3 and the NMOS transistor M1, generating the offset voltage in the error amplifier 3 can be prevented. Inconsistencies in transistor quality occurring in the manufacturing process are further reduced, and the output voltage Vout can be further stabilized by isolation from the adverse effects of factors such as fluctuations in the power supply voltage Vdd and temperature changes.

(Second Embodiment)

Figure 3:
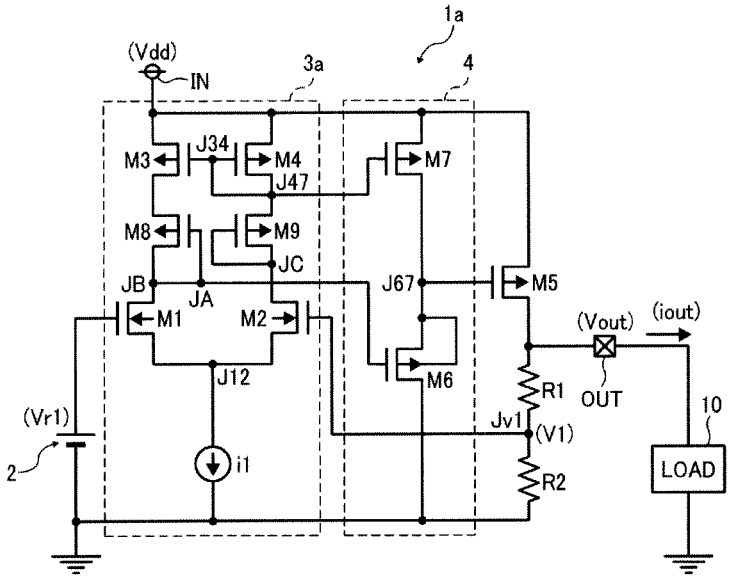
FIG. 3 illustrates circuitry of a power supply circuit according to a second illustrative embodiment.

FIG. 3 illustrates circuitry of a power supply 1*a* according to a second embodiment. The power supply circuit 1*a* includes an error amplifier 3*a* that differs from the error amplifier 3, instead of the error amplification circuit 3. In addition, the error amplifier 3*a* further includes a PMOS transistor M9. It is to be noted that, for ease of explanation and illustration, because other than the difference described above power supply circuit 1*a* has a circuit configuration similar to the circuit configuration of power supply circuit 1 in the first embodiment, other components of the error amplifier 3*a* are represented by identical reference numerals and descriptions thereof are omitted below.

As shown in FIG. 3, the power supply circuit 1*a* includes the PMOS transistor M9, serving as a fourth transistor, connected between the PMOS transistor M4 and the NMOS transistor M2.

In FIG. 3, the power supply circuit 1*a* according to the present embodiment functions as a series regulator in which a power supply voltage Vdd inputted through an input terminal IN is converted to a predetermined voltage for output as an output voltage Vout via an output terminal OUT. The power supply circuit 1*a* includes the reference voltage source 2, the resistors R1 and R2, the error amplifier 3*a*, the buffer circuit 4, and the output driver transistor M5. The reference voltage source 2 generates and outputs predetermined reference voltages Vr1. The resistors R1 and R2 are for setting output voltage by dividing output voltage Vout and output the voltage as a divided voltage Vd1. The buffer circuit 4 is controlled by the error amplifier 3. The output driver transistor 5 is formed by PMOS transistor and is controlled by the buffer circuit 4.

In the error amplifier 3*a* shown in FIG. 3, the PMOS transistor M9 is connected between the NMOS transistor M2 and the PMOS transistor M4. More specifically, the source of the PMOS transistor M9 is connected to the drain of the PMOS transistor M4 at the junction node J47, and the drain of the PMOS transistor M9 is connected to the drain of the NMOS transistors M2 at a junction node JC. The junction node JC serves as a third junction node. The gate (control terminal) of the PMOS transistor M9 is connected to the junction node JC.

For example, the output driver transistor M5, the PMOS transistors M3, M4, M6, M7, M8, and M9 are the same conductive type and the same size, and are driven by the same constant current. At this time, the drain voltage Vd1 of the NMOS transistor M1 is calculated by the following Formula 4.

$$Vd1=Vdd+Vgs5+Vgs6 \quad \text{(Formula 4)}$$

The gate-source voltage of the PMOS transistor M9 is set as Vgs9, the drain voltage Vd2 of the NMOS transistor M2 is calculated by the following Formula 5.

$$Vd2=Vdd+Vgs4+Vgs9 \quad \text{(Formula 5)}$$

For example, when the output driver transistor M5, the PMOS transistors, M4, M6, M8, and M9 are the same conductive type and the same size, and are driven by the same constant current, the voltages generated in the gate-source voltages become equal each other, therefore, the relation is represented by the following Formula 6.

$$Vgs4=Vgs5=Vgs6=Vgs9 \quad \text{(Formula 6)}$$

Therefore, with reference to the formula 4 through 6, relation of the drain voltage Vd1 of the NMOS transistor M1 and the drain voltage Vd2 of the NMOS transistor M2 is expressed by Vd1=Vd2, that is, the drain voltage Vd1 of the NMOS transistor M1 is set equal to the drain voltage Vd2 of the NMOS transistor M2, and accordingly, the influence for the channel length modulation depending on the drain voltage is kept, which prevents the offset voltage from generating.

As described above, the power supply circuit 1*a* according to the second embodiment can provide an effect similar to the power supply circuit 1 according to the first embodiment.

Numerous additional modifications and variations are possible in light of the above teachings. It is therefore to be understood that, within the scope of the appended claims, the disclosure of this patent specification may be practiced otherwise than as specifically described herein.

This patent specification claims priority from Japanese Patent Application No. 2009-246693, filed on Oct. 27, 2009 in the Japan Patent Office, which is hereby incorporated by reference herein in its entirety.

What is claimed is:

1. A power supply circuit to generate a predetermined constant voltage from an input voltage and output the predetermined constant voltage as an output voltage, the power supply circuit comprising:

an input terminal and an output terminal;

an output driver transistor to generate a predetermined current according to a control signal input from the input terminal and output the predetermined current from the output terminal;

a buffer circuit to control the output driver transistor according to the inputted control signal, comprising a first transistor connected to the output terminal and a second transistor to function as a load for the first transistor; and an error amplification circuit to control the output driver transistor via the buffer circuit to make a proportional voltage proportional to the output voltage equal to a predetermined reference voltage comprising:

a differential pair including a first pair of transistors;

a current mirror circuit including a second pair of transistors, to function as a load for the differential pair;

a constant current source to supply a current and drive the differential pair and the current mirror circuit; and a third transistor connected between one of the first pair of transistors constituting the differential pair and the second pair of transistors constituting the current mirror circuit, wherein the first and second transistors of the buffer circuit have the same polarity as the second pair of transistors constituting the current mirror of the error amplification circuit, a control terminal of the third transistor of the error amplification circuit is connected at a first junction node to a control terminal of the first transistor of the buffer circuit, and the first junction node is connected to a second junction node between (i) one of the first pair of transistors constituting the differential pair of the error amplification circuit and (ii) the third transistor of the error amplification circuit, and wherein the third transistor of the error amplification circuit is connected to the control terminal of the first transistor of the buffer circuit to turn on and turn off the first transistor which controls the output driver transistor.

2. The power supply circuit of claim 1, wherein the respective transistors comprise MOS transistors, and a drain of the first transistor is grounded and a source and a substrate gate of the first transistor are connected to a gate of the output driver transistor, and a gate of the first transistor is connected to an output terminal of the error amplification circuit.

3. The power supply circuit of claim 2, wherein the second transistor constitutes a current mirror circuit with the second pair of transistors constituting the current mirror circuit of the error amplification circuit.

4. The power supply circuit of claim 1, wherein the error amplification circuit further comprises a fourth transistor, connected between the other of the first pair of transistors constituting the differential pair and the transistors constituting the current mirror circuit, wherein a control terminal of the fourth transistor is connected to a third junction node between the fourth transistor and the other of the first pair of transistors constituting the differential pair.

5. The power supply circuit of claim 4, wherein the respective transistors comprise MOS transistors, and a drain of the first transistor is grounded and a source and a substrate gate of the first transistor are connected to a gate of the output driver transistor, and a gate of the first transistor is connected to an output terminal of the error amplification circuit.

6. The power supply circuit of claim 5, wherein the second transistor constitutes a current mirror circuit with the second pair of transistors constituting the current mirror circuit of the error amplification circuit.

7. The power supply circuit of claim 1, wherein the third transistor is a same conductive type as that of each of the first transistor, the second transistor, the output driver transistor and the second pair of transistors constituting the current mirror of the error amplification circuit.

8. The power supply circuit of claim 1, wherein the third transistor is a same conductive type and same size as that of each of the first transistor, the second transistor, the output driver transistor and the second pair of transistors constituting the current mirror of the error amplification circuit.

9. The power supply circuit of claim 1, wherein the first transistor and the second transistor are connected in series between ground and the input terminal, the output driver transistor is connected to a junction between the first transistor and the second transistor, and the third transistor is connected to the control terminal of the first transistor which controls the output driver transistor.

* * * * *